United States Patent [19]

Mitchell

[11] 4,120,335

[45] Oct. 17, 1978

[54] LAUNDRY BAG

[76] Inventor: Winalee G. Mitchell, c/o Principle Business Enterprises Inc., Pine Lake Industrial Park, Dunbridge, Ohio 43414

[21] Appl. No.: 785,975

[22] Filed: Apr. 8, 1977

Related U.S. Application Data

[63] Continuation-in-part of Ser. No. 700,262, Jun. 28, 1976, abandoned.

[51] Int. Cl.[2] ..... B65D 29/00

[52] U.S. Cl. ..... 150/7; 150/1; 150/12

[58] Field of Search ..... 150/1, 3, 7, 12; 229/53, 62

[56] References Cited

U.S. PATENT DOCUMENTS

| | | | |
|---|---|---|---|
| 1,496,462 | 6/1924 | Hunt | 150/7 |
| 2,616,469 | 11/1952 | Katz | 150/1 |
| 2,709,467 | 5/1955 | Hoeppner | 150/7 |
| 2,789,610 | 4/1957 | Pritchard | 150/7 |
| 3,409,063 | 11/1968 | Pokras | 150/3 |

*Primary Examiner*—Donald F. Norton

*Attorney, Agent, or Firm*—Pollock, Vande Sande & Priddy

[57] ABSTRACT

An improved laundry bag is disclosed which includes a combined bag closure and support band or flap having a specially configured lower edge which intersects the side seams of the bag at an acute angle. This angle of intersection distributes stresses developed in use in the closure and support band or flap so that the tendency to tear at the side seams or elsewhere is reduced substantially. The bag preferably is made from bias-cut material, which minimizes puckering of seams and adds extra stretchiness to the product. The bag also includes an improved form of handle pocket at its lower end. A method of manufacture which minimizes material wastage is also disclosed.

8 Claims, 12 Drawing Figures

FIG.11
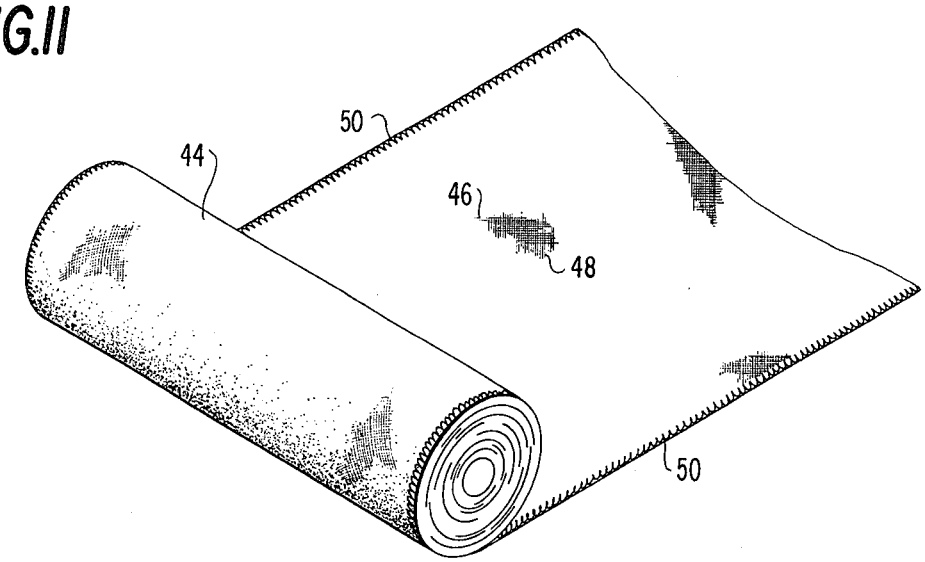
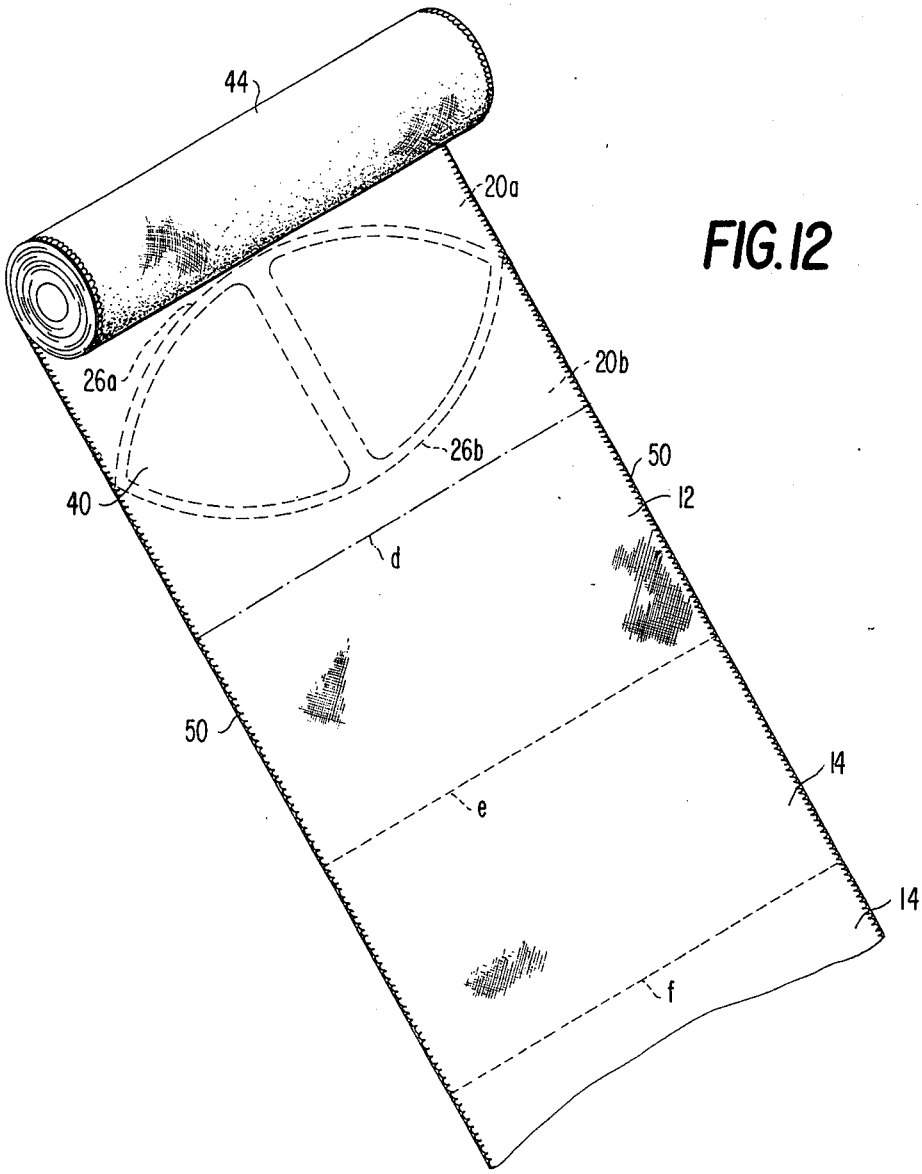
FIG.12

LAUNDRY BAG

REFERENCE TO RELATED APPLICATION

This application claims the benefit of the effective filing date of my continuation-in-part application Ser. No. 700,262, filed June 28, 1976, which prior application was copending with this application but is now abandoned.

BACKGROUND OF THE INVENTION

Ever-growing pressure to control escalating costs of hospitalization has caused even the lowly hospital laundry bag to come under scrutiny. Such factors as first cost, bag capacity, handling efficiency, wear resistance, and ability to withstand rough handling without tearing or splitting (even after repeated washing of the bag itself) all enter into the cost picture. Considering the great frequency with which towels, bed linens, wearing apparel, and other fabric items are changed and laundered in routine hospital operations, necessitating the maintenance of a large inventory of laundry bags which are used over and over again, small differences in the above-mentioned cost factors can have significant economic impact. Evidencing this fact, knowledgeable purchasers of hospital supplies have established detailed specifications for such bags with the objective of achieving maximum performance at the least possible cost.

Among the bags meeting existing specifications is a commercial product similar to the prior art bag disclosed in U.S. Pat. No. 2,789,610, to R. J. Pritchard. Such bags include a flap, stitched to the sides of the bag, which acts as a combined bag closure and support band. When the bag is open, the flap forms a pocket with a downwardly directed mouth which can be slipped over the back of a chair to support the bag. When this pocket is pushed inside out and slipped over the top opening of the bag itself, it serves as a closure, protecting the bag contents from loss and further soiling.

Heretofore, there has been a problem of tearing of this flap, or of the stitching which secures it to the side seams of the bag. To provide adequate strength in the face of rough handling, gussets have been cut out and sewn between the lower edge of the flap and the side seams of the bag. This measure contributes significantly to the construction costs of these bags. Nevertheless, the use of such gussets has generally been accepted heretofore as an important factor in achieving adequate resistance against destruction of the bags by rough handling.

OBJECTS OF THE INVENTION

The invention and its various embodiments are directed to one or more and, in some instances, to all of the following objects:

An object of the invention is to provide an improved laundry bag having a combined bag closure and support band or flap which is specially configured to eliminate the need for reinforcement gussets and yet maintains adequate strength to resist tearing at the side seams.

Another object of the invention is to provide an improved laundry bag having a rounded bottom panel which increases the useful volume of the bag.

Still another object of the invention is to provide a laundry bag having a pair of handle pockets at the lower end of the bag to facilitate emptying the bag.

Yet another object of this invention is to provide an improved method of bag manufacture which minimizes material wastage.

A further object is to provide a laundry bag of bias-cut material to improve manufacturing ease and stretchiness of the product.

These objects of the invention are given only by way of example. Thus, other desirable objects and advantages inherently achieved by the disclosed structure may occur to those skilled in the art upon reading this specification.

SUMMARY OF THE INVENTION

According to the invention, the lower edge of that flap on a laundry bag which constitutes a combined bag closure and support band and which is attached to opposite sides of the bag by a pair of upstanding seams, intersects with each of said seams at an acute angle. The flap is otherwise free of seams which intersect with said lower edge. The result is a bag which is less costly to produce — requiring no gussets — which is highly resistant to splitting or tearing of the aforementioned seams or of the material adjacent to said seams and along said lower edge.

The savings effected in this manner make it possible, if desired, to provide the bag with cylindrical walls and a rounded bottom panel, thereby significantly increasing its capacity, while retaining the overall cost of the bag at a very reasonable level.

If the aforementioned flap — or, more preferably, the entire bag — is of a bias cut cloth fabric, a particulary damage-resistant structure is thereby obtained.

Since the center of the flap is narrower than its sides, it is possible to practice a particularly advantageous method of cutting bag components from a fabric, resulting in better utilization and savings of fabric. The method is described below.

If the flap lower edge describes a substantially continuously concave curve, it tends to redistribute tearing forces exerted intermediate the ends of said lower edge, apparently further increasing resistance against such tearing forces.

If the acute angle portions of the flap are connected by a substantially continuously concave curve and the material is bias-cut, the application of a pucker-free binding to the curved edge is an easier and less time consuming task, saving production costs.

In a particularly convenient to handle form of the laundry bag of the invention, the bag is defined at least in part by two side panels joined by upstanding seams, which panels form a substantially cylindrical wall portion when the bag is filled; and a lateral extension of one or both of said side panels, having a free upstanding edge, extends to the outside of the bag from each of said upstanding seams, said extensions being folded against the outer surface of the bag and having their lower edges secured to the bag to form handle pockets.

In a particularly easy to manufacture version, the pair of handle pockets is formed adjacent the bottom of the cylindrical wall portion by lateral extensions of both side panels from both of said upstanding seams, forming double thicknesses of fabric which are folded back at essentially diametrically spaced locations to overlie the cylindrical wall portion.

When the bag includes a handle pocket or pockets and a bottom panel having a peripheral seam along which it is joined to the lower edges of the side panels, the lower edges of the extension or extensions which form the handle pockets may be secured to the bag by said peripheral seam.

The method of cutting out bag components, referred to above, includes cutting two of the above-mentioned flaps from a single piece of material. The flaps are cut from the material along cutting lines corresponding to the two lower edges of the respective flaps, thereby defining a panel of fabric between the cutting lines. This panel is then formed into one or more other components of the bag, such as a bottom panel, and is preferably divided into a pair of bottom panels for a pair of laundry bags. According to an optional but advantageous aspect of this method, each of the aforementioned flaps is formed integral with, i.e., from the same continuous running length of material, as one of the side panels which in part defines the side walls of the bag. The line of intersection between the top of the flap and the top edge of the adjoining side panel can be a stress point when the bag is in use, assuming this line of intersection defines the top of the pocket which is used to hang the bag on a chair or other object. When this line of intersection is formed by a fold in a single piece of fabric, which includes both the flap and the side panel, the tensile strength of the full thickness and width of the material is made available at this stress point.

BRIEF DESCRIPTION OF THE DRAWINGS

FIG. 11 shows a bolt of bias-cut material.

FIG. 12 shows how the bag components are laid out on the material in accordance with the method of the invention.

DETAILED DESCRIPTION OF THE PREFERRED EMBODIMENTS

Figure 1:
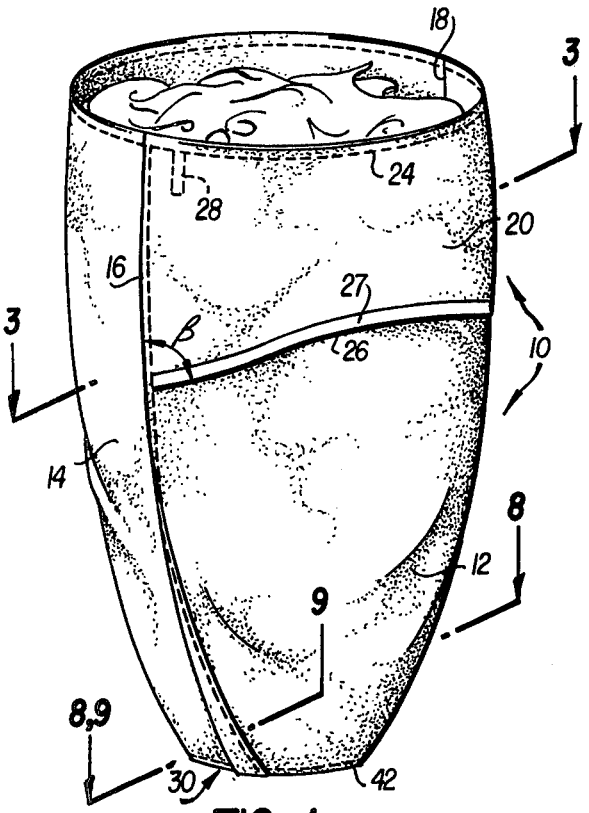
FIG. 1 shows a perspective view of a laundry bag according to the invention in which the combined closure and support band is in its support position so that the bag may be filled with laundry.

There follows a detailed description of the preferred embodiments of the invention, reference being made to the drawings in which like reference numerals identify like elements of structure in each of the several figures. Although the invention has particular utility as a laundry bag, those skilled in the art will appreciate that it has additional applications.

The bag is made of any sheet material having the requisite strength and flexibility, but is preferably made of fabric, and more preferably a heavy woven cloth such as canvas or the like. The most preferred material is a woven blend of polyester and cotton.

Referring to FIGS. 1–4, a laundry bag 10 according to the invention comprises a front wall portion or panel 12 and a rear wall portion or panel 14 which, if laid flat, would be rectangles of essentially equal area. Wall portions 12 and 14 are joined together along upstanding side seams 16 and 18 to form an essentially cylindrical bag, as illustrated. In this instance, the upstanding seams are essentially vertical. Those skilled in the art will realize that the wall portions 12 and 14 could also be made from a single piece of material rather than the two pieces illustrated, without departing from the scope of the invention.

Front wall portion 12 includes as an integral extension thereof a combination bag closure and support band or flap 20 which extends across the front of the bag from the vertical side seam 16 to vertical side seam 18. At its center, flap 20 has a depth of about three-fourths of the diameter of the top opening of the bag to provide enough material for closing the bag; however, this depth may be varied somewhat without departing from the scope of the invention. As illustrated in FIG. 1, flap 20 is folded down in front of front wall portion 12 and sewn to the upper perimeter 22 of bag 10 by means such as an upper seam 24. Flap 20 is also secured to both front and rear portions 12 and 14 by side seams 16 and 18.

The lower edge 26 of support and closure flap 20 is smoothly, concavely curved toward the center of the flap so that it intersects side seams 16 and 18 in upwardly opening acute angles $\beta$. A preferred form for edge 26 is essentially circular, having an average radius of at least about five eights and more preferably at least about three fourths of the width of flap 20. If the angle $\beta$ is any amount substantially less than 90°, one may obtain a measure of the advantages of the invention; however, an angle in the range of about 20° to 60° has been found to be preferable, with about 45° being considered best. This configuration of the lower edge of flap 20 eliminates the need for the reinforcing gussets commonly used in prior art laundry bags, thereby simplifying manufacture of the device.

As stress is placed on flap 20, it is distributed along a substantially longer portion of side seams 16 and 18 than would be the case if the lower edge of flap 20 intersected the side seams at a right angle. The upwardly curved shape of edge 26 also facilitates closing the full bag to the condition shown in FIG. 2, since the center of the flap is narrower and may be flipped over the bag more easily. Thus, the combined support and closure band according to the present invention considerably simplifies construction of the laundry bag without any sacrifice in bag strength and convenience of use. Preferably, a binding tape 27 of a distinctive color is added to the lower edge 26 for identification and appearance purposes.

In the bag-open configuration illustrated in FIG. 1, bag 10 would be supported by a chair back or support frame, not shown, which would be inserted behind flap 20, thereby leaving the bag open at its upper end for receiving laundry in the conventional manner. When the bag has been filled, it is removed from the support, and flap 20 is pulled over the top of the bag to the bag-closed position illustrated in FIG. 2 in which the bag may be transported without spilling its contents.

Figure 5:
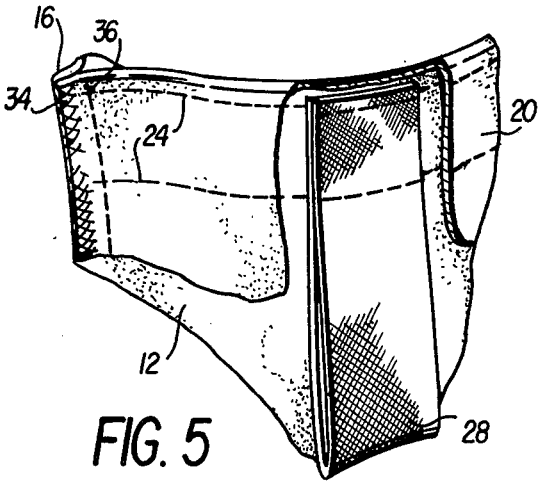
FIGS. 5 and 6 show the manner in which gripping loops are attached to the upper portion of the bag according to the invention, to facilitate closing the bag.
Figure 6:
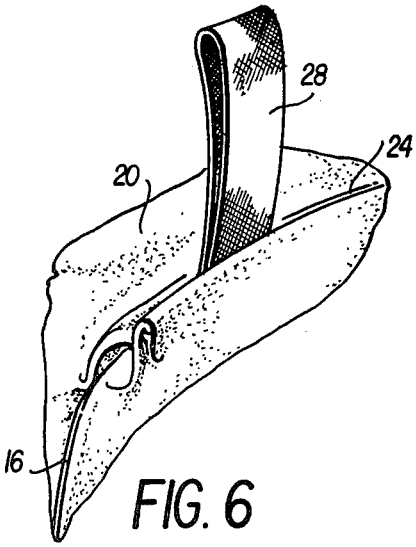
Figure 10:
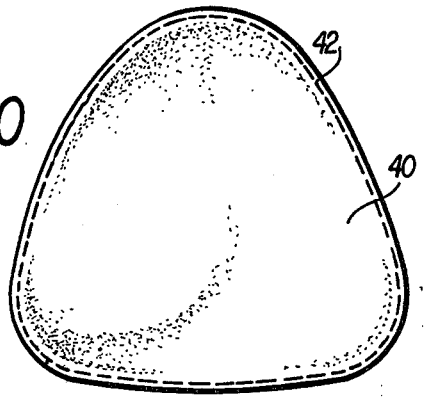
FIG. 10 shows a bottom view of a laundry bag according to the invention.

FIGS. 5 and 6 show gripping loops 28 which may be provided, if desired, for assisting the user in changing the flap 20 of a filled bag from the bag-supporting to the bag-closure position. Loops 28 may, for instance, be secured between flap 20 and front wall portion 12 by stitched seam 24. To close the bag, the user reaches under flap 20, grips loops 28, and pulls them downward and out from under flap 20. Then, when the weight of the filled bag is lifted by loops 28, the pocket formed by the flap 20 and the adjacent side wall panel is pulled inside out and the flap is thus flipped over to the closed position shown in FIG. 2.

Figure 2:
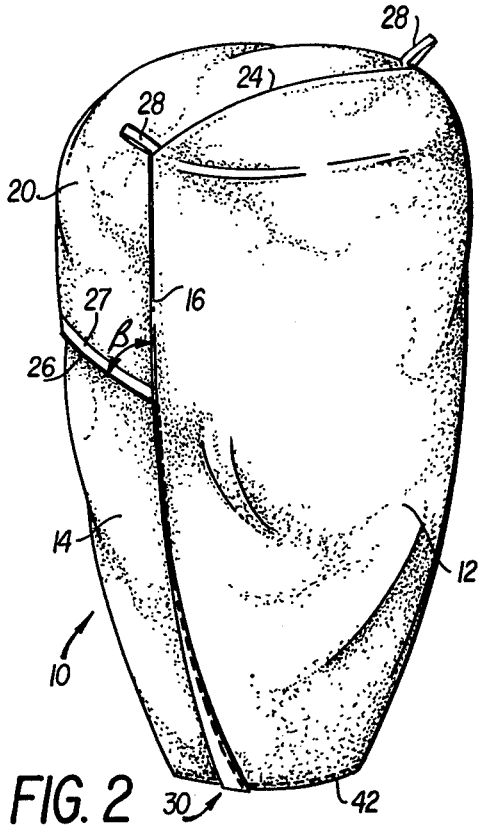
FIG. 2 shows a laundry bag according to the invention with the combined bag support and closure band arranged in its closed position so that the bag may be transported without spilling its contents.
Figure 3:
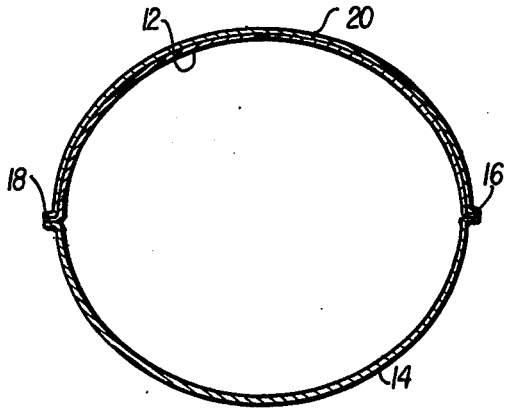
FIG. 3, and an enlarged portion of it.
Figure 8:
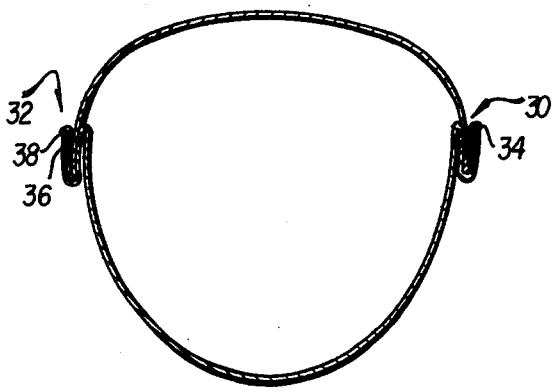
FIG. 8 shows a section taken along line 8—8 of FIG. 1, indicating the location of the handle pockets according to the invention.
Figure 9:
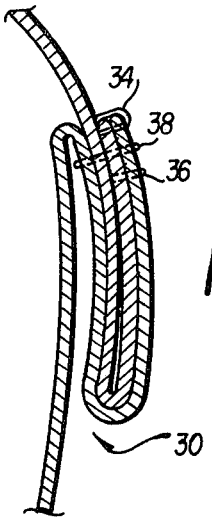
FIG. 9 shows an enlarged view taken along line 9—9 of FIG. 1 indicating the geometry of the handle pockets according to the invention.
Figure 4:
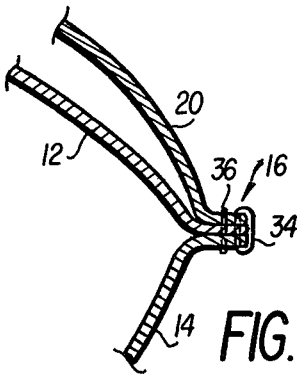
FIG. 4, show the mode of attachment of the bag closure/support band to the body of the bag.
Figure 7:
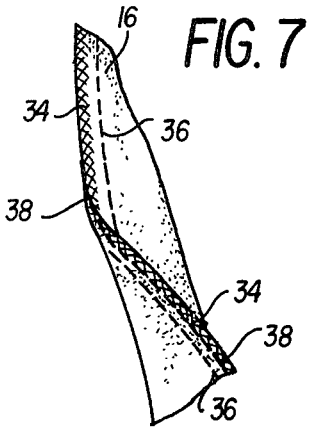
FIG. 7 shows the upper portion of the handle pockets according to the invention indicating the manner in which the bag wall is folded to form the pocket structure.

Referring again to FIGS. 1 and 2 and particularly to FIGS. 7 to 9, the practice of the invention may also include provision of a pair of handle pockets 30 and 32 located at the lower end of bag 10, which can be used to carry the loaded bag once it has been closed as in FIG. 2. As shown in FIG. 7, side seams 16 and 18 comprise an overcast stitch portion 34 which prevents unravelling of the bag material and a straight stitch portion 36 which secures front and rear portions 12 and 14 to each other. In this preferred embodiment, a double thickness of the bag wall, comprising extensions of wall portions or panels 12 and 14, and possibly the lower portions of side seams 16 and 18, are folded back against the main body or cylindrical wall portion of the bag. The fold, which is essentially triangular in configuration as shown in FIGS. 1 and 2, is then sewn back through both thicknesses of the bag as best seen in FIG. 9, using a third straight stitch 38 which tapers pockets 30 and 32 to open gradually from a location below flap 20 toward the lower edge of wall portions 12 and 14.

A bottom portion or panel 40 of essentially circular shape may be sewn to wall portions 12 and 14 and to the lower edges of pockets 30 and 32 by a seam 42. Thus, an essentially round bag is provided which provides maximum carrying volume.

Bag 10 is generally inverted when full and while being transported to assure hygienic protection and to prevent spilling of the bag contents. Handle pockets 30 and 32 facilitate the lifting and handling of the bag in the inverted position, as well as the emptying of the bag. Due to the presence of folded, double thicknesses of bag material in the outer edges of pockets 30 and 32, the pocket handles are particularly strong and have sufficient thickness to provide a good grip for the user.

An optional but quite advantageous feature of the invention is the construction of flap 20, and possibly other parts of the bag, or most preferably the entire bag, of bias-cut material. Such material is a woven cloth having a warp and weft, which is so oriented in the bag that the warp and weft both run at an appropriate angle to the bag seams, e.g. side seams 16 and 18, to impart lateral stretchiness to the one or more parts of the bag, thereby minimizing stresses on the seams and/or spreading tearing forces exerted on the lower edge of flap 20. One may employ any andle greater than 0° and less than 90° which is sufficient to perform the foregoing function, but the angle of the warp and weft relative to the side seams will generally be in the range of about 10° to 80°, more preferably about 15° to 75° and most preferably about 20° to 70°.

The bias-cut arrangement is most conveniently provided by using cloth supplied in running lengths in which the warp and weft are both "on the bias" (skewed at the above-described angle) relative to the edge of the cloth. Then any straight edges of those bag components which are intended to be of bias-cut material can be laid out on or parallel to the edge of the cloth. However, if raw material with the warp and weft on the bias is not available, one can use material in which the warp and weft run parallel and perpendicular to the edge of the cloth, laying out the bag components with their edges at an appropriate angle to the edge of the cloth. However, this last-mentioned alternative can prove wasteful of material.

If the flap 20 is made of cloth which is not bias-cut material, e.g. the warp or weft of the cloth run parallel and perpendicular to side seams 20, the curved edge 26 will normally be bound with bias tape. This is a narrow tape woven on the bias which, when sewn onto edge 26, will more readily conform to its curvature than square woven ribbon or the like. However, an advantage of having the flap 20 bias-cut, is that its edge 26 can be more quickly and conveniently self-hemmed than the corresponding edge of a flap which is not bias-cut. Generally, puckering of the edge during self-hemming is reduced.

FIG. 11 shows a bolt 44 of bias-cut material of the type preferred for use in the invention. The warp 46 and weft 48 of the material are at angles of about 15° and about 75° to the edges of the cloth. Such material has considerable give or "stretchiness" in the length or width direction, and preferably in both directions, so that the bags fabricated therefrom are particularly stretchy. This stretchiness helps to reduce localized stressing of the bag seams.

In FIG. 12, bolt 44 has been unrolled to illustrate a unique method constituting one advantageous technique for manufacture of bags according to the invention. Each of the flaps 20*a* and 20*b*, integral with an adjoining wall portion 12 (only one of which is shown), are laid out on the material using paper patterns or any other suitable means, with their lower edges 26*a* and 26*b* facing each other as illustrated. The boundary between the flap 20*b* and its integral side wall panel or portion 12 is indicated by dot-dash line *d*. Two rounded bottom panels or portions 40 are laid out in the rounded panel of material between edges 26*a* and 26*b* and two sidewall panels or portions 14 are laid out in series with and between each pair of wall portions 12. The material is then cut on the dashed lines *e* and *f* to produce the components of a bag according to the invention with virtually no waste material.

Having described my invention in sufficient detail to enable those skilled in the art to make and use it, I claim:

1. In a bag which includes a wall portion and a flap secured to the upper portion of said wall portion, said flap having a bag-open position in which said flap forms a pocket with a downwardly directed mouth to receive a means for supporting said bag, and a bag-closed position in which said pocket has been pushed inside out and slipped over an opening in the top of the bag, said flap being attached to opposite sides of the wall portion by a pair of upstanding seams, with which the lower edge of said flap intersects, the improvement characterized in that said flap, when laid flat in an unstretched condition, is narrower at the center than at the side edges thereof, and said lower edge, viewed with the flap in both the bag-open position and the bag-closed position, intersects with each of said seams at an acute angle, said flap being otherwise free of seams which intersect with said lower edge.

2. A bag according to claim 1, wherein said lower edge, when laid flat in an unstretched condition, is curved upwardly toward its center.

3. A bag according to claim 1, wherein at least said flap is of bias-cut material.

4. A bag according to claim 1, wherein said wall portion and flap are of bias-cut material.

5. A bag according to claim 1, wherein said wall portion is substantially cylindrical and said bag has a closed lower end with an essentially circular bottom portion and a pair of handle pockets located in the bottom portion of said cylindrical wall portion comprising a double thickness of said cylindrical wall portion folded back upon itself at essentially diametrically spaced locations on said cylindrical wall portion and secured to said bottom portion to form said pockets.

6. A bag according to claim 5, wherein said cylindrical wall portion is made up from front and rear portions joined by a pair of seams at said diametrically spaced locations.

7. In a bag of the type including an essentially cylindrical wall portion having a closed lower end with an essentially circular bottom panel joined to said cylindrical wall portion, the improvement comprising: a pair of handle pockets located in the bottom portion of said cylindrical wall portion comprising a double thickness of said cylindrical wall portion folded back upon itself at essentially diametrically spaced locations on said cylindrical wall portion, said double thickness being secured to itself and to said bottom portion to join said pockets.

8. A bag according to claim 7, wherein said cylindrical wall portion is made up from front and rear portions joined by a pair of seams at said diametrically spaced locations.

* * * * *